US005715706A

United States Patent [19]

Rathbone

[11] Patent Number: 5,715,706

[45] Date of Patent: Feb. 10, 1998

[54] AIR SEPARATION

[75] Inventor: Thomas Rathbone, Farnham, England

[73] Assignee: The BOC Group plc, Windlesham, England

[21] Appl. No.: 697,756

[22] Filed: Aug. 29, 1996

Related U.S. Application Data

[63] Continuation of Ser. No. 533,199, Sep. 25, 1995, Pat. No. 5,582,035, which is a continuation of Ser. No. 231,541, Apr. 22, 1994.

[30] Foreign Application Priority Data

Jul. 9, 1993 [GB] United Kingdom ..... 9314213
Apr. 30, 1996 [GB] United Kingdom ..... 9309012

[51] Int. Cl.[6] ..... F25J 3/04
[52] U.S. Cl. ..... 62/646; 62/900
[58] Field of Search ..... 62/646, 900

[56] References Cited

U.S. PATENT DOCUMENTS 4,356,013 10/1982 Linde et al. .
4,604,116 8/1986 Erickson .

*Primary Examiner*—Christopher Kilner
*Attorney, Agent, or Firm*—David M. Rosenblum; Salvatore P. Pace

[57] ABSTRACT

Cooled and purified air is introduced into a higher pressure rectification column and separated into oxygen-enriched liquid and nitrogen vapour. A stream of the oxygen-enriched liquid is flashed through a pressure reducing valve to form a mixture of liquid further enriched in oxygen and vapour depleted of oxygen. The liquid is reboiled by reboiler. A stream of the further enriched liquid is reboiled in condenser and is introduced into a lower pressure rectification column for separation into oxygen and nitrogen products. Reflux for the columns and is formed by condensing in condenser nitrogen vapour separated in the higher pressure rectification column. A reboiler provides an upward flow of vapour through the column. The condenser and reboiler take the form of a single heat exchanger. The reboiler is located in a phase separator, the reboiler is located in a rectification column containing liquid-vapour contact devices above the level at which fluid issuing from the valve is introduced. Oxygen-depleted vapour is condensed in the condenser by heat exchange with the further enriched liquid and at least some of the resulting condensate introduced into the lower pressure rectification column.

13 Claims, 6 Drawing Sheets

AIR SEPARATION

RELATED APPLICATIONS

This is a continuation application of U.S. Ser. No. 08/533,199 filed Sep. 25, 1995, now U.S. Pat. No. 5,582,035, which was a continuation application of U.S. Ser. No. 08/231,541 filed Apr. 22, 1994.

BACKGROUND OF THE INVENTION

This invention relates to a method and apparatus for separating air.

Air is separated commercially by rectification. The most frequently used air separation processes include the steps of compressing a stream of air, purifying the resulting stream of compressed by removing water vapour and carbon dioxide therefrom and cooling the stream of compressed air by heat exchange in a main heat exchanger with returning product streams to a temperature suitable for its rectification. The rectification is performed in a so-called "double rectification column" comprising two rectification columns, one operating at higher pressures than the other, a top region of the higher pressure rectification column being in heat exchange relationship with a bottom region of the lower pressure rectification column. Most or all of the cooled air is introduced into the higher pressure rectification column and is separated therein into oxygen-enriched liquid air and nitrogen vapour. The nitrogen vapour is condensed in a condenser-reboiler. A part of the resulting condensate is used as liquid reflux in the higher pressure rectification column. Oxygen-enriched liquid air is withdrawn from the bottom of the higher pressure rectification column, is sub-cooled, and is introduced into an intermediate region of the lower pressure rectification column through a pressure-reducing valve. This oxygen-enriched liquid air is separated into oxygen and nitrogen products in the lower pressure rectification column. These products may be withdrawn in the vapour state from the lower pressure rectification column and form the returning streams against which the incoming air stream is heat exchanged.

Liquid reflux for the lower pressure rectification column, is provided by taking the rest of the liquid nitrogen condensate, sub-cooling it, and passing the resulting sub-cooled liquid into the top of the lower pressure rectification column through a pressure reducing valve.

Conventionally, the lower pressure rectification column is operated at pressures in the range of 1 to 1.5 bar. At such pressures it is desirable to use liquid oxygen at the bottom of the lower pressure rectification column to meet the condensation duty at the top of the higher pressure rectification column. Sufficient liquid oxygen is evaporated thereby to meet the requirements of the lower pressure rectification column for reboil and to enable a good yield of gaseous oxygen product to be achieved. It is known however that the yield of oxygen can deteriorate if changes are made to the operating conditions of the lower pressure rectification column. For example, with increasing operating pressures in the lower pressure rectification column, and hence in the higher pressure rectification column as well, the yield of oxygen becomes progressively lower. Such a reduction in the yield of oxygen can be attributed to a relative lack of liquid nitrogen reflux in the lower pressure rectification column. According to EP-A-0 384 688, the liquid nitrogen reflux from the higher pressure rectification columns may be supplemented by taking a part of the nitrogen product from downstream of its heat exchange with the incoming air, compressing it, passing the compressed nitrogen back through the main heat exchanger cocurrently with the incoming air, and condensing the cooled, compressed nitrogen by heat exchange with a part of the oxygen-enriched liquid air. This modification of the air separation process has however a limited efficiency and requires additional compression machinery.

The method and apparatus according to the present invention relate to a different approach to addressing the problem of compensating for any shortage of liquid reflux in the lower pressure rectification column.

SUMMARY OF THE INVENTION

According to the present invention there is provided a method of separating a mixture comprising nitrogen and oxygen, comprising the steps of:

a) introducing a stream of the mixture into a higher pressure rectification column and separating it into oxygen-enriched liquid and nitrogen vapour;

b) condensing at least part of the nitrogen vapour and employing a first stream of the condensate as reflux in the higher pressure rectification column and a second stream of the condensate as reflux in a lower pressure rectification column;

c) introducing a stream of the oxygen-enriched liquid into an intermediate vessel below liquid-vapour mass exchange devices therein at a pressure intermediate the pressure at the top of the higher pressure rectification column and the pressure at the bottom of the lower pressure rectification column, and separating the oxygen-enriched liquid by rectification therein into an oxygen-depleted vapour and liquid further enriched in oxygen;

d) reboiling a part of the further-enriched liquid and thereby forming more oxygen-depleted vapour;

e) reducing the pressure of a stream of the further-enriched liquid and employing it to condense at least some of the oxygen-depleted vapour so as to form condensed vapour and an at least partially vaporised, further enriched liquid, and introducing at least part of the partially vaporised, further enriched liquid into the lower pressure rectification column;

f) introducing at least part of the said condensed vapour of step (e) into the lower pressure rectification column or taking at least part of the said condensed vapour as product or both;

g) separating an oxygen product from fluid introduced into the lower pressure rectification column; and h) reboiling liquid oxygen separated in the lower pressure rectification column by heat exchange with the condensing nitrogen vapour of step (b).

In all embodiments of the present invention a gaseous nitrogen product can be withdrawn from the higher pressure column. In place of the above step (e) at least some of the oxygen-depleted vapour can be condensed by indirect heat exchange with liquid from an intermediate mass exchange level of the lower pressure rectification column, and at least some of the further-enriched liquid is introduced into the lower pressure rectification column. The liquid from the intermediate level of the lower pressure rectification column is typically at least partially reboiled, and the resulting vapour employed to enhance the flow of vapour through at least a region of the lower pressure rectification column. When the oxygen-depleted vapour is condensed by heat exchange with liquid from the intermediate level of the lower pressure rectification column no liquid nitrogen reflux for the higher and lower pressure rectification columns is formed by indirectly heat exchanging liquid from an intermediate mass exchange region of the lower pressure rectification column with nitrogen vapour from the higher pressure rectification column.

Further or alternatively, step (c) can be replaced by steps of passing a stream of the oxygen-enriched liquid through a pressure-reducing valve to form a further mixture comprising liquid further enriched in oxygen and vapour depleted of oxygen and introducing the further mixture into an intermediate vessel at a pressure intermediate the pressure at the top of the higher pressure rectification column and the pressure at the bottom of the lower pressure rectification column so as to separate therein the vapour phase from the liquid phase.

Operation of the intermediate vessel effectively reduces the amount of separation which needs to be performed in the lower pressure rectification column. The method according to the invention may for example be used to maintain oxygen yields relatively high in circumstances in which they would otherwise tend to fall, for example when operating the lower pressure rectification column at top pressures in the range of 2.5 to 6.5 bars, when withdrawing liquid oxygen from the lower pressure rectification column typically at elevated pressure when forming a liquid nitrogen product, or when taking some nitrogen product from the higher pressure rectification column. Significant advantages in terms of power savings can be achieved by introducing the stream of oxygen-enriched liquid into the intermediate vessel below rather than above liquid-vapour mass exchange devices in the intermediate vessel.

The mixture comprising nitrogen and oxygen is typically formed by separating water vapour and carbon dioxide from a stream of compressed air, and cooling the resultant purified air stream to a cryogenic temperature suitable for its separation by rectification. The cooling is preferably carried out by indirect heat exchange in a main heat exchanger countercurrently to oxygen and nitrogen streams withdrawn from the lower pressure rectification column.

Reducing the pressure of the stream of oxygen enriched liquid introduced into the higher pressure rectification column causes a mixture of oxygen depleted gas and liquid further enriched in oxygen to be formed. Reboiling this liquid further enhances its oxygen content such that the stream of further-enriched liquid that is used to condense the oxygen-depleted gas typically contains from 35% to 55% by oxygen.

The reboiling associated with the intermediate vessel may if desired be performed upstream thereof.

It will be appreciated that in some example of the method according to the invention the intermediate vessel simply comprise a phase separator enabling the oxygen-depleted gas to be disengaged from the further enriched liquid, but in other examples is of a kind which enables rectification to take place therein, and it may therefore comprise a conventional rectification column and produce nitrogen as the oxygen-depleted vapour.

If the intermediate vessel is merely a phase separator none of the condensed oxygen-depleted vapour is typically returned to the intermediate vessel; nor is any typically taken as product; all of the condensate is preferably introduced into the lower pressure rectification column.

As method above, rectification in the intermediate vessel can be used to produce a nitrogen vapour fraction at its top. Condensation of such nitrogen vapour enables liquid nitrogen to be produced. If desired, some of this liquid nitrogen may be taken as product.

If rectification takes place in the intermediate vessel, some of the condensed oxygen-depleted vapour is desirably returned thereto as reflux; the remainder of the condensed oxygen-depleted vapour is typically introduced into the lower pressure rectification column.

It is not typically necessary for all the further-enriched liquid that is withdrawn from the intermediate vessel to be passed through the second condenser. Excess further-enriched liquid that is withdrawn from the intermediate vessel may be introduced directly into the lower pressure rectification column.

Feeding of the condensed oxygen-depleted vapour at a substantial rate to the lower pressure rectification column is made possible by reboiling the further enriched liquid. Such reboiling may be effected by a reboiler associated with a sump at the bottom of the intermediate vessel, or by a reboiler upstream of an inlet to the intermediate vessel.

The further oxygen-enriched liquid is preferably reboiled by indirectly heat exchanging it with a stream of nitrogen vapour withdrawn from the higher pressure rectification column. The nitrogen stream is typically at least partially condensed by such heat exchange. The resulting partially or wholly condensed nitrogen stream is preferably introduced into the lower pressure column as reflux. Accordingly using nitrogen from the higher pressure rectification column to reboil the intermediate vessel need not deprive the lower pressure rectification column of reflux from this source.

The oxygen product may be withdrawn from the lower pressure rectification column in vapour or liquid state. If gaseous oxygen product at relatively high pressure is required (or an oxygen product at above the critical pressure of oxygen), liquid oxygen may be withdrawn from the lower pressure rectification column by means of a pump and raised thereby to a chosen elevated pressure. The pressurised liquid oxygen may be vaporised by indirect heat exchange with a stream of purified air (or other mixture comprising nitrogen and oxygen) at a substantially higher pressure than the liquid oxygen itself. Preferably, however, conversion of the pressurised liquid oxygen to a gas is effected in a liquid-vapour contact column of the mixing kind in which a descending flow of the pressurised liquid oxygen is mixed with an ascending flow of pressurised vaporous air to produce gaseous oxygen and liquid air products.

The gaseous oxygen product of the mixing column is preferably passed through the main heat exchanger in countercurrent indirect heat exchange with the incoming purified air stream. The oxygen-enriched liquid air product of the mixing column is preferably reduced in pressure and introduced into the higher pressure rectification column or the intermediate vessel.

A method and apparatus according to the invention are able to produce oxygen at a given high pressure when using a mixing column of the kind described above at a higher yield than a comparable method and apparatus using higher pressure and lower pressure rectification columns and a mixing column but no intermediate vessel and are particularly advantageous when the lower pressure rectification column operates at a pressure at its top above 2.5 bar so as to enable a pressurised nitrogen product to be produced.

BRIEF DESCRIPTION OF DRAWINGS

Methods and apparatus according to the invention will now be described by way of example with reference to the accompanying drawings, in which.

The drawings are not to scale.

DETAILED DESCRIPTION

Figure 1:
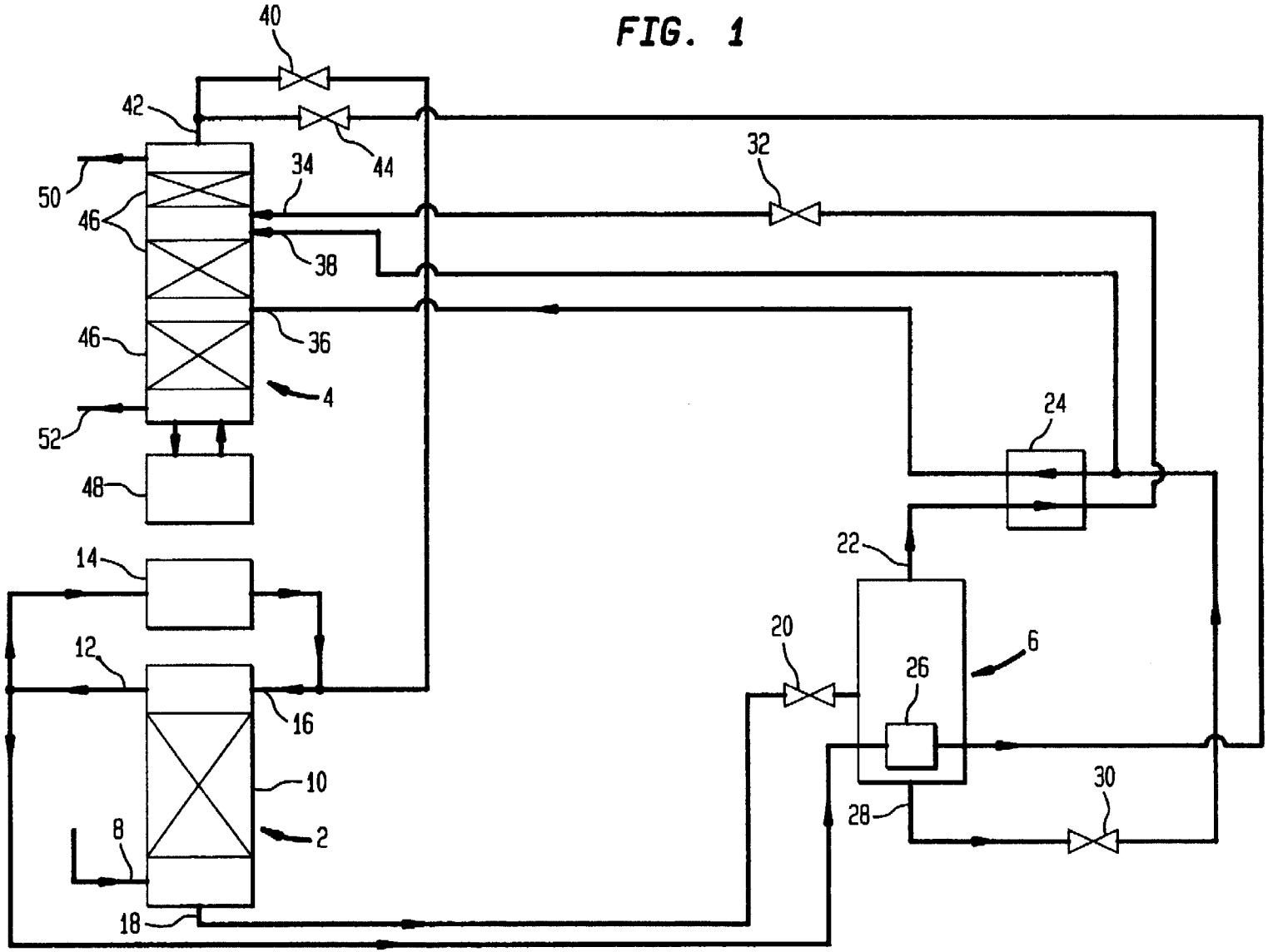
FIG. 1 is a schematic flow diagram showing a first arrangement of rectification apparatus for use in the method according to the invention.

Referring to FIG. 1 of the drawings, the illustrated arrangement of rectification columns comprises a higher pressure rectification column 2 and a lower pressure rectification column 4. There is in addition, a separator vessel 6 in which no rectification takes place.

A compressed vaporous stream of a mixture of nitrogen and oxygen is introduced into the higher pressure rectification column 2 at approximately its saturation temperature through an inlet 8. The compressed stream of nitrogen and oxygen is formed by removing relatively volatile impurities, particularly water vapour and carbon dioxide from a stream of compressed air at approximately ambient temperature and cooling the resulting purified air stream.

The higher pressure rectification column 2 contains liquid-vapour contact means or devices 10 whereby a descending liquid phase is brought into intimate contact with an ascending vapour phase such that mass transfer between the two phases takes place. The descending liquid phase becomes progressively richer in oxygen and the ascending vapour phase progressively richer in nitrogen.

The liquid-vapour contact means 10 may comprise an arrangement of liquid-vapour contact trays and associated downcomers or may comprise a structured or random packing. A volume of liquid (not shown) typically collects at the bottom of the higher pressure rectification column 2. Since the inlet 8 is, as shown in FIG. 1, located below the entire liquid-vapour contact means 10 the liquid at the bottom of the higher pressure rectification column 2 is approximately in equilibrium with the incoming air. Accordingly, since oxygen is less volatile than the other main components (nitrogen and argon) of the air, the liquid at the bottom the higher pressure rectification column 2 has an oxygen concentration greater than that of the incoming air, ie is enriched in oxygen.

A sufficient number of trays or a sufficient height of packing is included in the liquid-vapour contact means 10 for the vapour fraction passing out of the top of the liquid-vapour contact means to be essentially pure nitrogen. A stream of pure nitrogen vapour is withdrawn from the top of the higher pressure rectification column 2 through an outlet 12 and is divided into two subsidiary streams. One of the subsidiary streams is passed through a condenser 14 and is condensed therein. One stream of the resulting condensate is returned to the top of the higher pressure rectification column 2 through an inlet 16 and provides liquid reflux for the column 2. Another stream of the condensate from the condenser 14 is, as will be described below, used as liquid reflux in the lower pressure rectification column 4.

A stream of oxygen-enriched liquid is withdrawn from the bottom of the higher pressure rectification column 2 through an outlet 18 and is flashed through a first pressure reducing valve 20. (The term 'pressure reducing valve' is used herein to refer to the kind of valve often alternatively termed an 'expansion valve' or a 'throttling valve'. A pressure reducing valve need have no moving parts and may simply comprise a length of pipe with a step between an inlet portion of smaller internal cross-sectional area and as outlet portion of larger internal cross-sectional area. As fluid flows over the step so it undergoes a reduction in pressure.)

Since nitrogen is more volatile than oxygen, flashing of the oxygen-enriched liquid through the pressure reducing valve 20 causes the resultant flash gas to be depleted in oxygen and the residual liquid to be further enriched in oxygen. The resultant mixture of oxygen depleted gas and liquid further enriched in oxygen flows into the phase separation vessel 6.

The liquid phase disengages from the vapour phase in the vessel 6. Accordingly a volume of further-enriched liquid is collected in the bottom of the vessel 6 and a volume of oxygen-depleted gas thereabove. A stream of oxygen-depleted gas is withdrawn from the top of the vessel 6 through an outlet 22 and is condensed in a second condenser 24. In order to enhance the rate at which oxygen-depleted gas is able to be withdrawn from the vessel 6 through the outlet 22, liquid is continuously reboiled therein in a reboiler 26 which may be of the thermosiphon kind. Heating for the reboiler 26 is provided by passing therethrough the other subsidiary stream of nitrogen vapour formed from the stream leaving the top of the higher pressure rectification column 2 through its outlet 12. The nitrogen vapour is at least partially and typically completely condensed in the reboiler 26. The resulting nitrogen condensate is used, as will be described below, to provide liquid reflux for the lower pressure rectification column 4.

The further-enriched liquid at the bottom of the phase separation vessel 6 is not totally reboiled therein. A stream of the further-enriched liquid is withdrawn from the bottom of the vessel 6 through an outlet 28 and flows through a second pressure reducing valve 30. A part or all of the resulting fluid stream flows through the second condenser 24 countercurrently to the condensing oxygen-depleted gas stream and is at least partially boiled by indirect heat exchange therewith. The resulting vaporous oxygen-enriched stream, the condensed oxygen-depleted stream formed in the second condenser 24, and any oxygen-enriched fluid not passed through the condenser 24 are all separated in the lower pressure rectification column 4 as will be described below.

The phase-separation vessel 6 is operated at a pressure intermediate the operating pressures of the higher pressure and lower pressure rectification columns 2 and 4. Typically, if the lower pressure column 4 has an operating pressure at its bottom of approximately 1.5 bar and the higher pressure rectification column 2 has an operating pressure at its top of approximately 5.3 bar, the operating pressure of the phase separation vessel may be in the order of 3 bar.

Three streams are introduced into the lower pressure rectification column 4 for separation. The first of these streams is the condensed oxygen-depleted stream from the second condenser 24. This stream flows from the condenser 24 through a pressure reducing valve 32 and enters the lower pressure rectification column 4 through an inlet 34. The second of the streams taken for separation in the lower pressure rectification column 4 is the further-enriched stream which is boiled in the condenser 24. This second stream is introduced into the lower pressure rectification column through an inlet 36.

The third of the streams taken for separation in the lower pressure rectification column 4 is that part of the further-enriched liquid stream which from downstream of the second pressure reducing valve 30 by-passes the second condenser 4. This third stream is introduced into the lower pressure rectification column through an inlet 38. A first portion of liquid nitrogen reflux for the lower pressure rectification column 4 is provided by taking that part of the nitrogen condensate from the first condenser 14 which is not returned to the higher pressure rectification column 2, passing it through a pressure reducing valve 40, and introducing it into the top of the lower pressure rectification column 4 through an inlet 42. A second portion of liquid nitrogen reflux for the lower pressure rectification column 4 is provided by taking a stream of nitrogen condensate from the reboiler 26, passing it through a pressure reducing valve 44, and uniting it with the other stream of liquid nitrogen reflux in the inlet 42.

The lower pressure rectification column 4 contains liquid vapour contact means or devices 46 whereby a descending liquid phase is brought into intimate contact with an ascending vapour phase such that mass transfer between the two phases takes place. The liquid-vapour contact means 46 may be of the same kind as or a different kind from the liquid-vapour contact means 10.

In order to provide an adequate flow of vapour upwardly through the lower pressure rectification column 4, liquid oxygen collecting at the bottom of the column 4 is reboiled in a reboiler 48 which is typically of the thermosiphon kind and is accordingly located within a volume of the liquid oxygen in the lower pressure rectification column 4 itself. The vapour formed in the reboiler 48 ascends the lower pressure rectification column 4 and by virtue of the liquid-vapour contact means 46 comes into intimate contact with a descending liquid phase.

Mass transfer between the two phases takes place, the vapour phase becoming progressively more depleted of oxygen as it ascends the column 4. Similarly, the liquid phase becomes progressively depleted of nitrogen as it descends the lower pressure rectification column 4. The purity of the resultant oxygen product depends in part on the number of distillation trays or the height of packing used as the liquid-vapour contact means 46. A product containing 95% by volume of oxygen requires far fewer trays or a much small height of packing for its separation than a product containing, say, at least 99.5% by volume of oxygen, the reason being that the former product requires essentially no separation of argon from the oxygen. Since oxygen and argon have similar volatilities, a relatively large number of distillation trays or a relatively large height of packing is needed to separate argon from oxygen.

Typically, the three streams of fluid for separation in the lower pressure rectification column 4 are each introduced therein into fluid of the same phase and approximately the same composition as the respective stream to be separated.

The first condenser 14 and the reboiler 48 are provided by a single unit in which nitrogen vapour from the higher pressure rectification column enters into indirect heat exchange relationship with liquid oxygen to be reboiled. The nitrogen is thereby condensed.

A gaseous nitrogen product is withdrawn from the top of the lower pressure rectification column 4 through an outlet 50. An oxygen product in gaseous or liquid state is withdrawn from the bottom of the column 4 through an outlet 52. (If desired, oxygen products in both liquid and gaseous states may be separately withdrawn from the lower pressure rectification column 4.)

Figure 2:
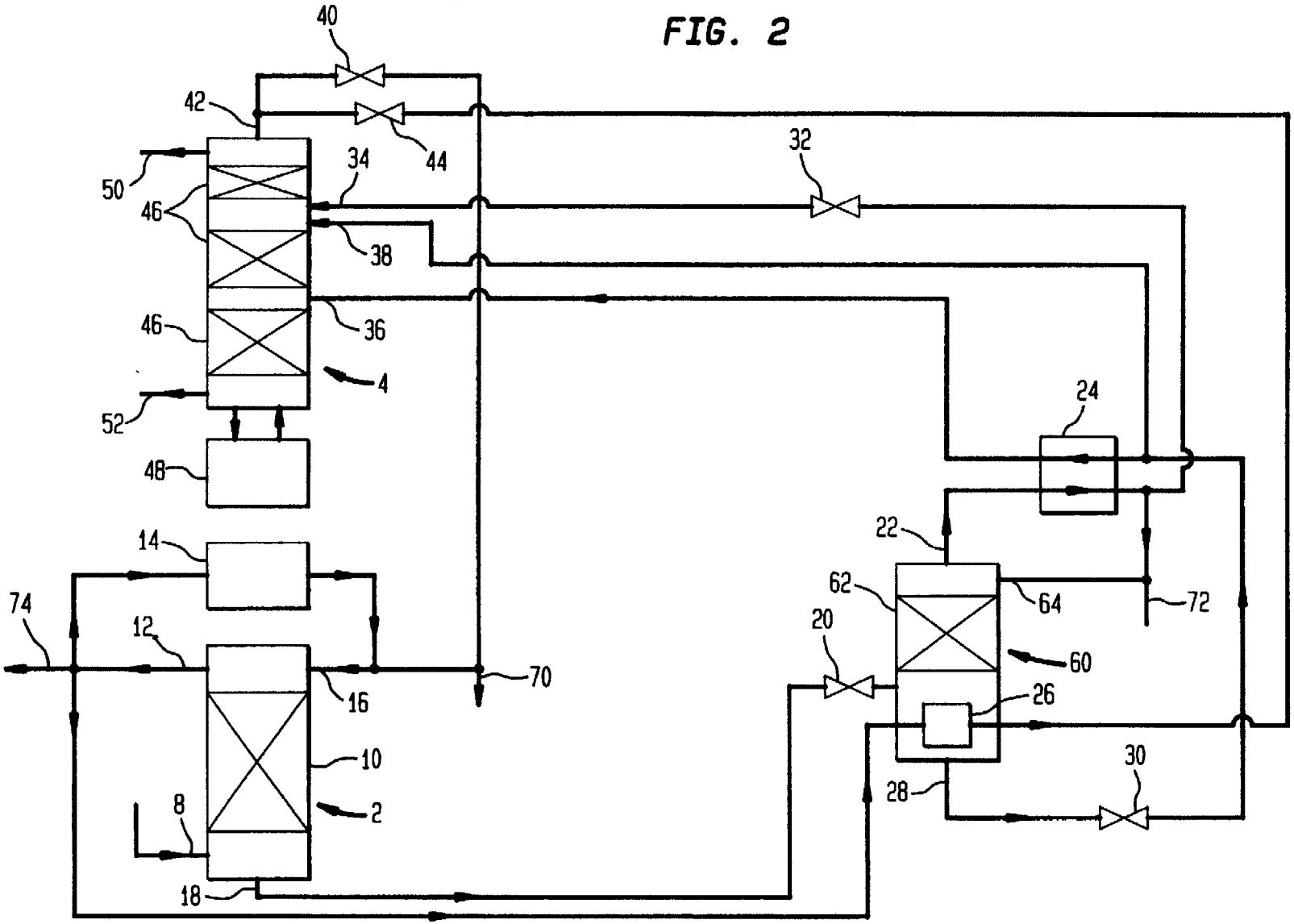
FIG. 2 is a schematic flow diagram showing a second arrangement of rectification apparatus for use in the method according to the invention.

In the apparatus shown in FIG. 2 the separator vessel 6 is replaced by a third or intermediate rectification column 60. Like parts shown in FIGS. 1 and 2 are identified therein by the same reference numerals. In general, the lay-out and operation of the apparatus shown in FIG. 1; accordingly only differences between the respective apparatuses and their operation will be referred to in FIG. 2.

Referring to FIG. 2, a stream of a mixture of flash gas and further-enriched liquid passes from the first pressure reducing valve 20 and enters the intermediate rectification column 60, below liquid-vapour contact means or devices 62, which are provided in the column 60 to bring an ascending vapour phase into intimate contact and hence mass transfer relationship with a descending vapour phase. The liquid-vapour contact means 62 may be of the same kind as or a different kind from the liquid vapour contact means 10.

By virtue of the liquid-vapour contact means 62, rectification takes place in the column 60 and thus in comparison with the apparatus shown in FIG. 1, the oxygen-depleted stream withdrawn from the top of the column 60 through the outlet 22 is relatively rich in nitrogen. If desired, substantially pure nitrogen may be supplied therefrom to the condenser 24. In order to satisfy requirements of the intermediate rectification column 60 for reflux a part of the condensate from the condenser 24 is returned to the top of the intermediate rectification column 60 through an inlet 64.

If the oxygen depleted vapour produced at the top of the intermediate rectification column 60 is substantially pure nitrogen the inlets 34 and 38 to the lower pressure rectification column 4 are typically positioned above the entire liquid vapour contact means 46 therein. If desired, some liquid nitrogen product may be withdrawn through an outlet 70 or 72, or high pressure gaseous nitrogen product through outlet 74.

Figure 3:
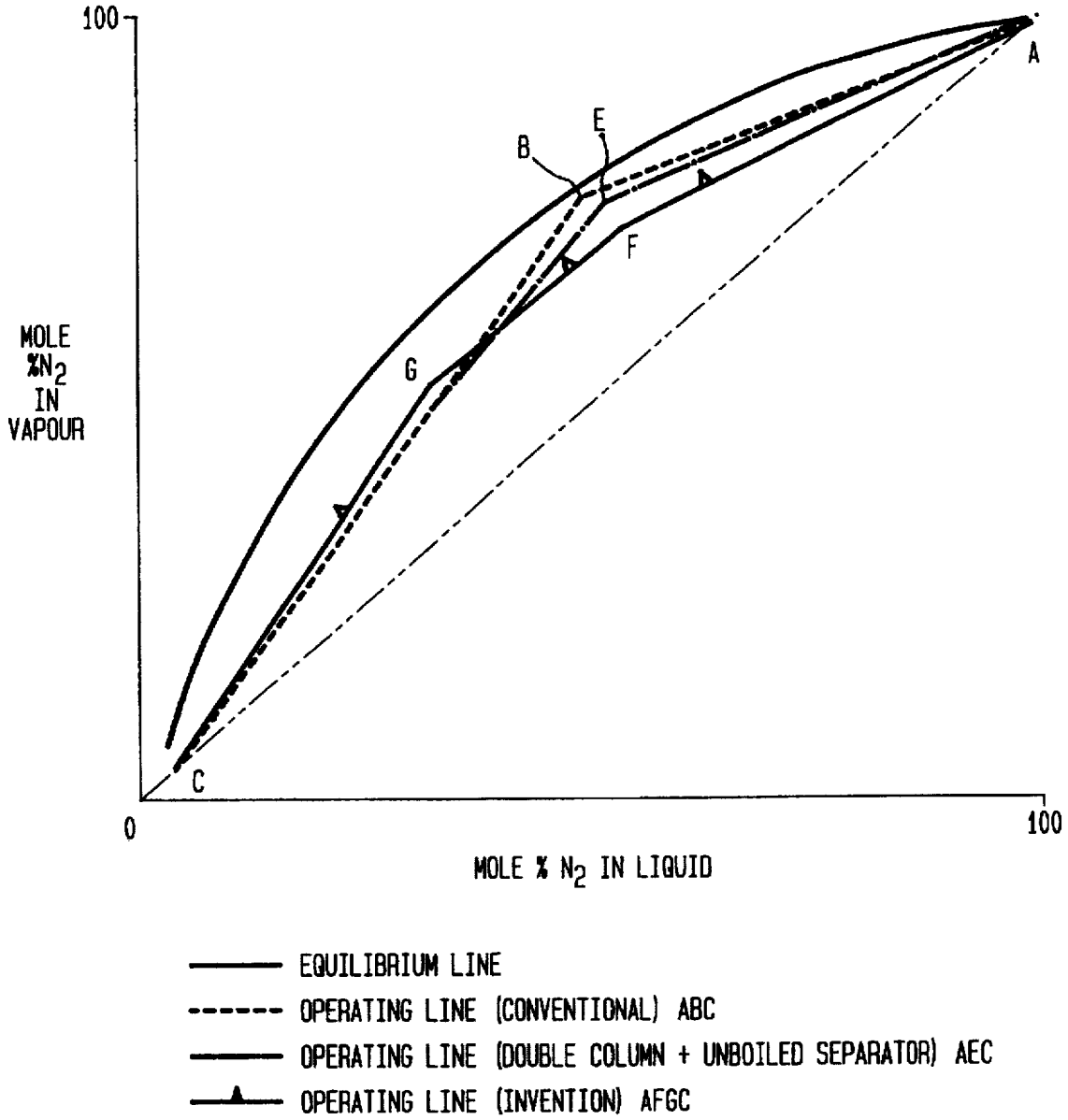
FIG. 3 is a McCabe-Thiele diagram illustrating the performance of the apparatus shown in FIGS. 1 and 2.

In conventional operation of a lower pressure rectification column, that is to say when introducing oxygen-enriched fluid into it for separation directly from a higher pressure rectification column without first passing the fluid into a reboiled intermediate vessel, difficulties can arise in obtaining an approximately full recovery of oxygen if, for example, one or more liquid products are withdrawn from the lower pressure rectification column or if the lower pressure rectification column is operated at pressures in excess of 3.5 bar. In FIG. 3 there are shown a number of curves generally representative of the operation of a lower pressure rectification column under various different conditions. The solid line is the equilibrium line for an oxygen-nitrogen mixture at an operating pressure of the lower pressure rectification column. The broken line ABC represents the aforementioned conventional operation of the lower pressure rectification column. The position of the equilibrium line may vary slightly according to the concentration of argon (normally present in air at a concentration of 0.9% by volume), but the plot still has validity for one component in a given column.

A pinch tends to occur at point B of the broken line ABC. This is where the oxygen-enriched fluid is introduced into the lower pressure rectification column. The consequence of the pinch is that if one attempts to raise the operating pressure of the lower pressure rectification column, oxygen recovery falls. As the operating pressure rises so the equilibrium line moves in towards the operating line and there is therefore less separation per theoretical stage. There is a similar effect in the higher pressure rectification column since raising the operating pressure in the lower pressure rectification column entails raising the operating pressure in the higher pressure rectification column. As a consequence, less liquid nitrogen is formed in the condenser reboiler linking the two columns. As a result, less liquid nitrogen flows to the lower pressure rectification column, thus exacerbating the adverse effect of the higher operating pressure. Conversely, lowering the operating pressure of column has the effect of ameliorating the pinch in that the point B is moved away from the equilibrium line.

Operation of the method according to the invention using the apparatus as shown in FIG. 1 or FIG. 2 but without a reboiler 26 has the effect that at a given pressure the pinch at the feed point of the oxygen-enriched fluid is less severe. The broken line AEC in FIG. 3 represents generally the operating line for the apparatus shown in FIG. 1 or FIG. 2 of the accompanying drawings when operated without a reboiler 26. (In practice the two operating lines will differ from one another in the section between points A and E, the size of the difference depending upon the amount of separation that is performed in the intermediate rectification column 60 of the apparatus shown in FIG. 2; for reasons of ease of representation the two operating lines are shown as being the same as one another in FIG. 3.) It will be seen that the distance between the point E and the equilibrium line is greater than the corresponding distance between point B and the operating line. Accordingly, the lower pressure rectification column may be operated at a somewhat higher pressure than in a conventional apparatus without oxygen recovery falling off. A substantial further improvement may be obtained by operation of the reboiler 26. When typically up to one third of the total nitrogen flow is passed through the reboiler 26 the shape of the operating line is considerably altered. The operating line is now represented in FIG. 3 by the line AFGC. Operation of the reboiler substantially enhances the rate of formation of oxygen-depleted vapour (typically nitrogen in operation of the apparatus shown in FIG. 2) and therefore by virtue of the condensation of this vapour enhances the liquid-vapour ratio (L/V) in the nitrogen-rich regions of the lower pressure rectification column 4 shown in FIG. 1 or FIG. 2. Thus the upper part AF of the line AFGC is moved further away from the equilibrium line. Moreover, the reboiling has the effect of producing a relatively-enriched liquid at the bottom of the vessel 6 shown in FIG. 1 or the intermediate rectification column 60 shown in FIG. 2.

The position of the introduction of this relatively-enriched liquid downstream of its at least partial vaporisation in the condenser 24 is represented by point G in FIG. 3. Although the position of point G is such that the operating line at this point is relatively near the equilibrium line in comparison with other points on the operating line AFGC, point G is in a position where there is a relatively large concentrate driving force. It can be seen qualitatively that the operating line AFGC is far apart from the equilibrium line and that there is room for a big increase in pressure before a pinch would again arise. Indeed, we believe it is possible to operate the lower pressure rectification column 4 of the apparatus shown in FIG. 2 at a pressure as high as about 6.5 bar without a significant fall in the oxygen recovery. (Such a lower pressure rectification column operating pressure corresponds to a higher pressure rectification column pressure of about 19 bar when the first condenser 14 and reboiler 48 shown in FIG. 2 form a single unit.)

Referring again to FIG. 3, reducing the reflux in the top section of the lower pressure rectification column will also have the effect of moving the sections AB, AE and AF of the operating lines ABC, AEC and AFGC respectively closer to the equilibrium line. With reference to FIG. 1 or 2, taking some of the liquid nitrogen formed in the condenser 14 as product effectively deprives the lower pressure rectification column 4 of reflux. Similarly, if the condenser 14 is cooled by liquid oxygen from the lower pressure rectification column 4, withdrawing liquid oxygen as a product stream from the column 4 reduces the availability of liquid oxygen for cooling the condenser 14 and therefore may also have the effect of reducing the amount of reflux made available to the lower pressure rectification column 4.

In view of the respective positions of the operating lines shown in FIG. 3, there is more scope for taking liquid products from the lower pressure rectification column 4 without having a significant adverse affect on the oxygen yield in the method according to the invention than there is in a conventional process for separating air employing higher and lower pressure rectification columns.

For reasons of ease of illustration, various heat exchangers have been omitted from FIGS. 1 and 2 of the drawings. In particular, it is generally preferred to sub-cool in a heat exchanger each liquid stream upstream of the passage of that stream through a pressure reducing valve, although such sub-cooling is typically not performed intermediate the outlet 28 of the vessel 6 in FIG. 1 (or the intermediate rectification column 60 in FIG. 2) and the pressure reducing valve 30. In addition, compressed, purified feed air is typically cooled by indirect heat exchange countercurrently to nitrogen and oxygen products. Moreover no means is shown in FIG. 1 or FIG. 2 of providing refrigeration to the illustrated arrangement of columns. Such refrigeration is typically provided by expanding in a turbine with the performance of external work either a part of the purified feed air being cooled or a part of the product nitrogen being warmed.

Figure 4:
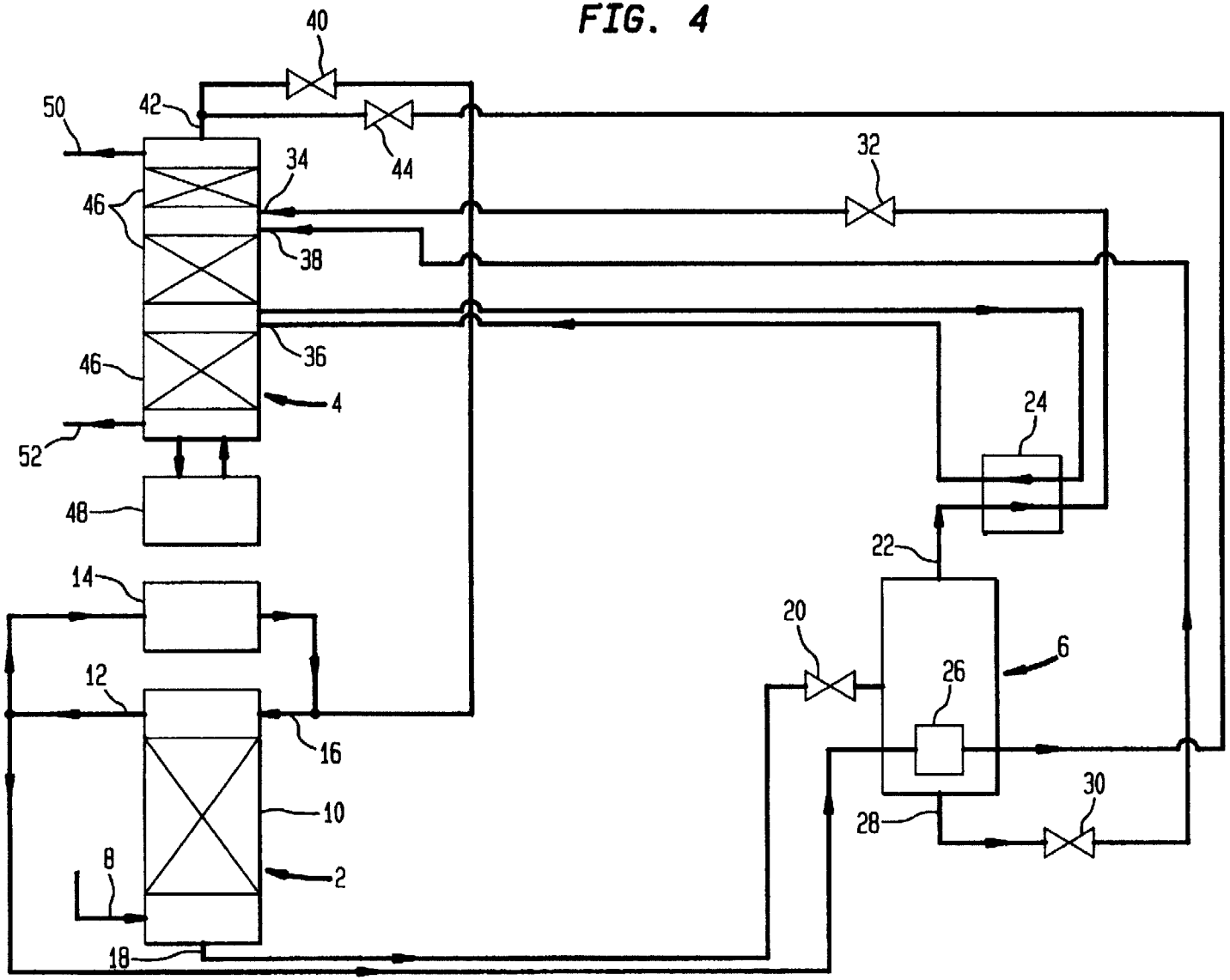
FIG. 4 is a schematic flow diagram showing an alternative embodiment of a rectification apparatus shown in FIG. 1.
Figure 5:
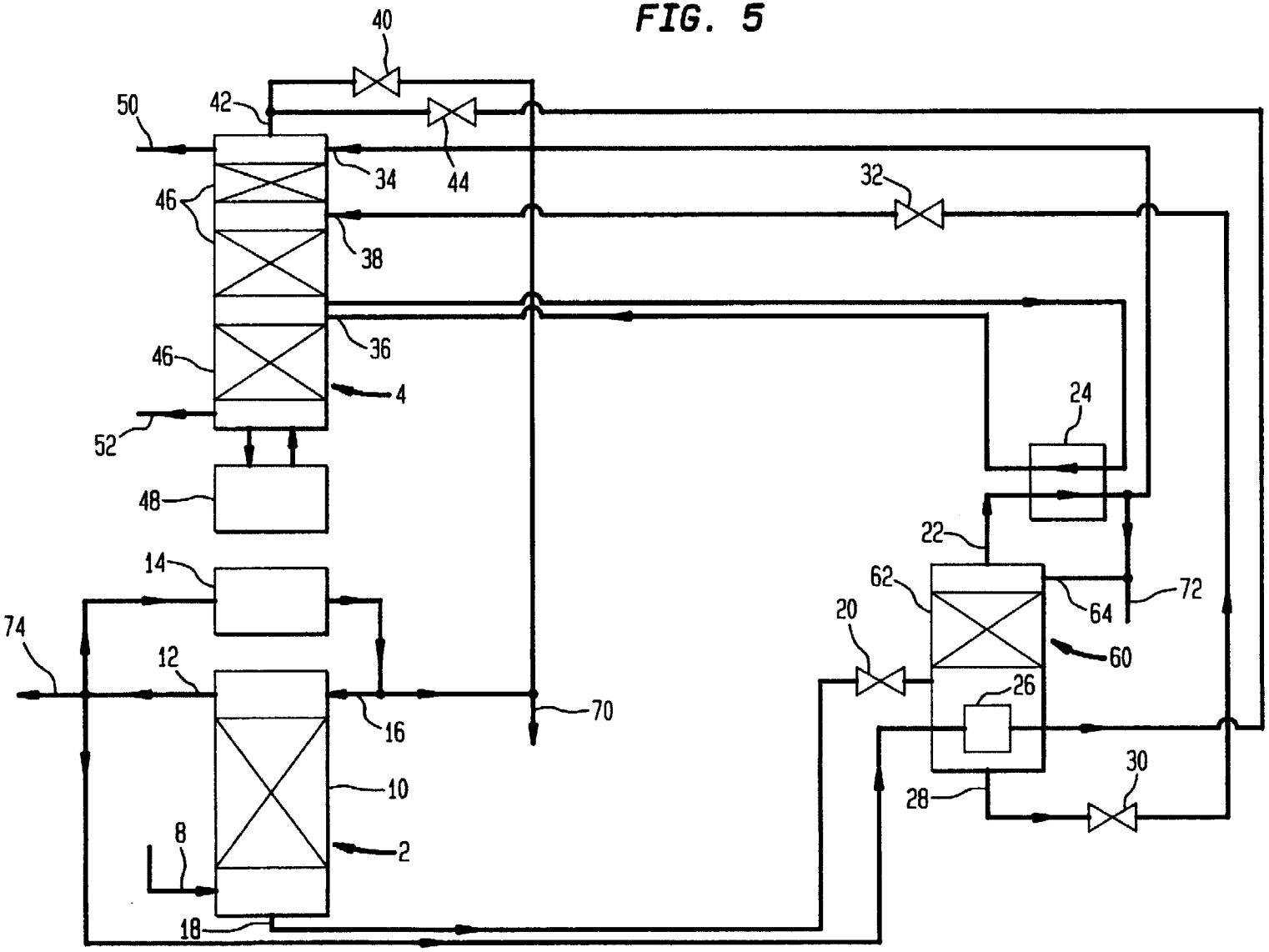
FIG. 5 is an alternative embodiment of the rectification apparatus illustrated in FIG. 2.

The method and apparatus shown in FIGS. 1 and 2 of the accompanying drawings may be modified as is illustrated in FIGS. 4 and 5 by employing the condenser 24 as an intermediate reboiler for the lower pressure rectification column 4, thus enhancing the vapour flow through chosen regions of the column 4.

In such a modification no reflux for the columns 2 and 4 is provided by cooling the condenser 14 with liquid from an intermediate region of the rectification column 4. Rather liquid from the bottom of the column 4 is used for this purpose.

Also, in such a modification, the fluid flowing out of the valve 30 typically all by-passes the condenser 24 and enters the column 4 through the inlet 38.

In another modification to the apparatus shown in FIG. 1, the reboiler 26 is located downstream of the valve 20 but upstream of the vessel 6.

Figure 6:
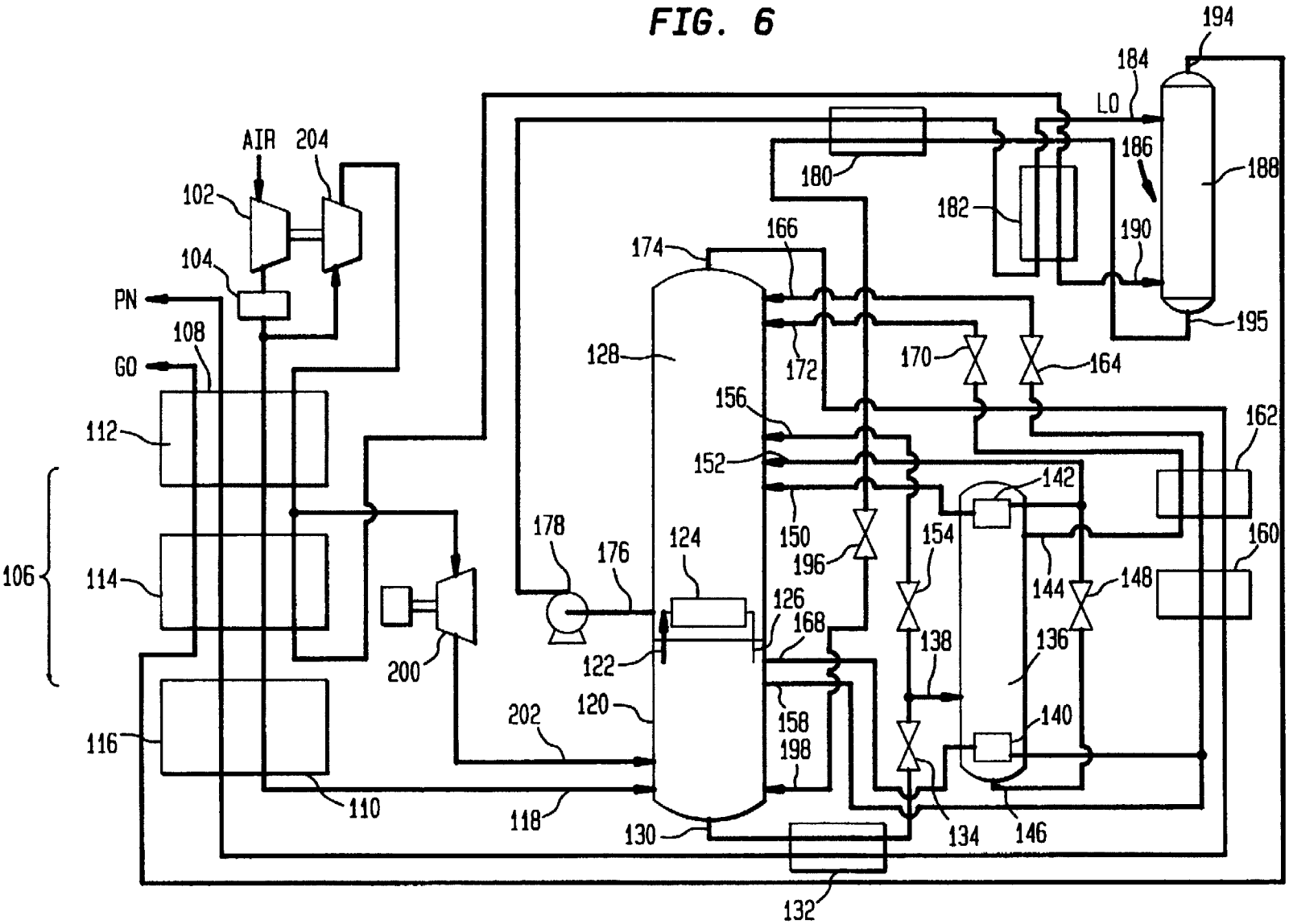
FIG. 6 is a schematic flow diagram of an air separation plant according to the invention.

Referring now to FIG. 6 of the drawings, there is illustrated a plant for separating air in accordance with the invention in which such heat exchangers and an expansion turbine are included. In addition to rectification columns of the kind shown in FIG. 2, the plant depicted in FIG. 4 additionally includes a liquid-vapour contact column for mixing an oxygen enriched liquid oxygen stream with an air stream to produce a gaseous oxygen product stream and a liquid air stream, such column being referred to as a 'mixing' column.

Still referring to FIG. 6, a feed air stream is compressed in a compressor 102 and the resulting compressed feed air stream is passed through a purification unit 104 effective to remove water vapour and carbon dioxide therefrom.

The unit 104 employs beds (not shown) of adsorbent to effect this removal of water vapour and carbon dioxide. The beds are operated out of sequence with one another such that while one or more beds are purifying the feed air stream the remainder are being regenerated, for example by being purged with a stream of hot nitrogen. Such a purification unit and its operation are well known in the art and need not be described further.

The purified feed air stream is divided into first and second air streams. The first air stream flows into a main heat exchanger 106 comprising in sequence from its warm end 108 to its cold end 110 stages 112, 114 and 116. The first air stream flows through the main heat exchanger 106 from its warm end 108 to cold end 110 and is thereby cooled from about ambient temperature to its saturation temperature (or other temperature suitable for its separation by rectification). The cooled first air stream is introduced into a bottom region of a higher pressure rectification column 120 through an inlet 118. The higher pressure rectification column 120 contains liquid-vapour contact means (not shown) whereby a descending liquid phase is brought into intimate contact with an ascending vapour phase such that mass transfer between the two phases takes place.

The descending liquid phase becomes progressively richer in oxygen and the ascending vapour phase progressively richer in nitrogen. The liquid-vapour contact means may comprise an arrangement of liquid-vapour contact trays and associated downcomers or may comprise a structured or random packing. A volume (not shown) of liquid typically collects at the bottom of the higher pressure rectification column 120.

The inlet 118 is typically located so that the air is introduced into the column 120 below the liquid-vapour contact means or otherwise such that the liquid at the bottom of the higher pressure rectification column 120 is approximately in equilibrium with the incoming air. Accordingly, since oxygen is less volatile than the other main components (nitrogen and argon) of the air, the liquid collecting at the bottom of the higher pressure rectification column 120 (typically in a sump) has an oxygen concentration greater than that of air, ie is enriched in oxygen.

A sufficient number of trays or a sufficient height of packing is included in the liquid-vapour contact means (not shown) for the vapour fraction passing out of the top of the liquid-vapour contact means to be essentially pure nitrogen. A first stream of the nitrogen vapour is withdrawn form the top of the higher pressure rectification column 120 through an outlet 122 and is condensed in a reboiler-condenser 124. The condensate is returned to the higher pressure rectification column 120 via an outlet 126 of the reboiler-condenser 124. A first stream of the condensate is used as reflux in the higher pressure rectification column 120; a second stream of the condensate is, as will be described below, used as liquid reflux in a lower pressure rectification column 128.

A stream of oxygen-enriched liquid (typically containing about 38% by volume of oxygen) is withdrawn from the bottom of the higher pressure rectification column 120 through an outlet 130 and is sub-cooled in a heat exchanger 132.

The sub-cooled oxygen-enriched liquid stream is flashed through a first pressure reducing valve 134 and a resultant mixture of a flash gas and residual liquid further enhanced in oxygen is formed. Sub-cooling of the further-enriched liquid keeps down the proportion of the liquid that is converted to flash gas.

Since nitrogen is more volatile than oxygen flashing of the oxygen-enriched liquid through the first pressure reducing valve 134 causes the resultant flash gas to be depleted in oxygen and the residual liquid to be further enriched in oxygen.

A first stream of the mixture of further-enriched liquid and oxygen-depleted gas is introduced into bottom region of an intermediate rectification column 136 through an inlet 138. As is described below, a second stream of the mixture of further-enriched liquid and oxygen-depleted gas is employed as a feed to the lower pressure rectification column 128. The rectification column 136 contains liquid-vapour contact means (not shown) that may be of the same kind as or a different kind from that used in the higher pressure rectification column 120.

The intermediate rectification column 136 is provided with a reboiler 140 at its bottom and a condenser 142 at its top. The reboiler 140 provides an upward flow of vapour from the bottom of the column 136, and the condenser 142 a downward flow of liquid from the top of the column 136 through the liquid-vapour contact means (not shown). The vapour as it ascends the column becomes progressively richer in nitrogen. There is desirably a sufficient number of distillation trays (not shown) or a sufficient height of packing (not shown) in the rectification column 136 for the vapour at the top to be almost pure nitrogen. A stream of the nitrogen liquid is withdrawn from a top region of the intermediate rectification column 136 through an outlet 144 and is used to provide reflux for the lower pressure rectification column 128 as is described below.

A stream of further-enriched liquid (typically containing about 48% by volume of oxygen) is withdrawn from the bottom of the intermediate rectification column 136 through an outlet 146 and is passed through a second pressure reducing valve 148 so as to reduce its pressure to approximately the operating pressure of the lower pressure rectification column 128.

A first stream of the resultant pressure-reduced further-enriched liquid (containing some vapour) flows through the condenser 142, thereby providing cooling for the condensation of the nitrogen vapour therein, and is itself at least partially vaporised. The resulting oxygen-enriched vapour stream is introduced into the lower pressure rectification column 128 as a first feed stream at an intermediate level through an inlet 150. A second stream of the resultant pressure-reduced further-enriched liquid by-passes the condenser 142 and is introduced into the lower pressure rectification column 128 as a second feed stream through an inlet 152. A third feed stream for the lower pressure rectification column 128 is formed by taking the aforesaid second stream of the mixture of further enriched liquid and oxygen-depleted gas and passing it through another pressure-reducing valve 154 so as to reduce its pressure to just above that at a chosen level of the lower pressure rectification column 128 and introducing it into the column 128 at that level through an inlet 156.

Separation of the three feed streams in the lower pressure rectification column 128 results in the formation of oxygen and nitrogen products. The lower pressure rectification column 128 therefore contains liquid-vapour contact means (not shown) whereby a descending liquid phase is brought into intimate contact with an ascending vapour phase such that mass transfer between the two phases takes place. The liquid-vapour contact means may be of same kind as or a different kind from the liquid-vapour contact means used in the higher pressure rectification column 120. Liquid nitrogen reflux for the lower pressure rectification column 128 is provided from three sources. The first is the aforesaid second stream of liquid nitrogen condensate which is withdrawn from the higher pressure rectification column 120 through an outlet 158. This stream of liquid nitrogen condensate is sub-cooled by passage through heat exchangers 160 and 162 in sequence and is reduced in pressure by passage through a pressure reducing valve 164 to approximately the operating pressure at the top of the lower pressure rectification column 128. The pressure reduced stream of liquid nitrogen is introduced into the lower pressure rectification column 128 through an inlet 166. The second source of liquid nitrogen reflux is a stream of nitrogen vapour withdrawn from the higher pressure rectification column 120 through an outlet 168. This stream of nitrogen vapour provides heating to the reboiler 140 in the bottom of the intermediate rectification column 136. The nitrogen is thereby condensed and the resulting nitrogen condensate is mixed with that taken from the higher pressure rectification column 120 via the outlet 158, the mixing taking place upstream of the passage of the liquid nitrogen through the heat exchanger 160. The reboiler 140 thereby assumes a sizeable part of the condensation duty for liquefying nitrogen separated in the higher pressure rectification column 120.

The third source of liquid nitrogen reflux for the lower pressure rectification column 128 is a stream of nitrogen condensate withdrawn from the intermediate rectification column 136 through the outlet 144. This stream is sub-cooled by passage through the heat exchanger 162 cocurrently with the other stream of liquid nitrogen flowing therethrough, and is reduced in pressure to approximately that at the top of the lower pressure rectification column 128 by passage through a pressure reducing valve 170. The resultant nitrogen stream is introduced into a top region of the lower pressure rectification column through an inlet 172.

An upward flow of vapour through the lower pressure rectification column 128 is created by the condenser reboiler 124 reboiling liquid oxygen that collects at the bottom of the column 128. Mass transfer between the ascending vapour and descending liquid causes the vapour phase to become progressively depleted of oxygen and the liquid phase to be progressively enriched in oxygen.

A gaseous nitrogen product is withdrawn from the top of the lower pressure rectification column 128 through an outlet 174 and is warmed by passage through the heat exchangers 162, 160, 132 and 106 in sequence. The necessary cooling is thereby provided for sub-cooling of streams in the heat exchangers 162, 160 and 132. Flow of the product nitrogen stream through the main heat exchanger 106 is from the cold end 110 to the warm end 108 and it thus provides cooling for the first air stream. The nitrogen stream leaves the warm end 108 of the main heat exchanger 106 at approximately ambient temperature.

An oxygen product is withdrawn in liquid state from a bottom region (or sump) of the lower pressure rectification column 128 through an outlet 176 by a pump 178. The conversion of the liquid oxygen product to a gas at high pressure is next described.

The pump 178 typically raises the pressure of the product oxygen stream to a pressure well in excess of the operating pressure of the higher pressure rectification column 120.

The pressurised liquid oxygen stream is warmed to approximately its saturation temperature by passage through heat exchangers 180 and 182 in sequence.

The resulting warmed liquid oxygen stream is introduced through an inlet 184 into the top of a mixing column 186. The mixing column 186 contains liquid-vapour contact means 188 which may be of the same kind as or a different kind from that used in the higher pressure rectification column 120. A mixing column is in essence a rectification column operated in reverse, ie with the top of the column at a higher temperature than the bottom of the column. In the mixing column 186 the pressurised liquid oxygen stream is mixed with a pressurised stream of purified air that is introduced into the bottom of the mixing column 186 through an inlet 190. As in a distillation column, the liquid vapour contact means 188 effects intimate contact between a descending liquid phase and an ascending vapour phase.

However, in the mixing column 186 the ascending vapour phase becomes progressively richer in oxygen (the less volatile component) and the descending vapour progressively richer in nitrogen (the more volatile component). Operation of the mixing column 186 thus enables the liquid oxygen product to be converted to the gaseous phase without substantial loss of pressure or purity, and a gaseous air stream to be converted to a liquid air stream.

The air stream that is introduced into the mixing column 186 through the inlet 190 is formed as is now described. The second stream of purified air is further compressed in a compressor 204 to a pressure a little in excess of the pressure at the bottom of the mixing column 186. The resulting further compressed second air stream flows through the main heat exchanger 106 from its warm end 108 to a region intermediate the stages 114 and 116, from which region it flows to the heat exchanger 182. The second air stream is cooled to approximately its liquefaction temperature by passage through the heat exchanger 182 by countercurrent heat exchange with the pressurised liquid oxygen stream. The resulting cooled air stream flows to the inlet and is thus the one which is introduced into the mixing column.

A pressurised gaseous oxygen product is withdrawn from the top of mixing column 186 through an outlet 194 and is introduced into the main heat exchanger 106 at a region intermediate its stages 114 and 116. The pressurised gaseous oxygen stream flows through the stages 114 and 112 of the main heat exchanger 106 in sequence and is thus warmed by countercurrent heat exchange with the streams being cooled. A pressurised, gaseous oxygen stream flows out of the warm end 108 of the main heat exchanger 106 at approximately ambient temperature. This gaseous oxygen product may for example be used in a partial oxidation process.

A stream of pressurised oxygen-enriched liquid air (typically containing about 36% of volume of oxygen) is withdrawn from the bottom of the mixing column 186 through an outlet 195 and is sub-cooled by passage through the heat exchanger 180 countercurrently to the pressurised liquid oxygen The sub-cooled oxygen-enriched liquid air stream flows through a pressure-reducing valve 196 and is thereby reduced in pressure to approximately that at the bottom of the intermediate rectification column 136.

The resulting pressure-reduced liquid air stream is introduced into a bottom region of the higher pressure rectification column 120 through an inlet 198. This introduction of the oxygen-enriched liquid air stream into the higher pressure rectification column 120 enhances the rate of production of nitrogen therein and hence the rate of supply of liquid nitrogen reflux to the lower pressure rectification column 128.

Refrigeration for the air separation is generated by operation of an expansion turbine 200 with the performance of external work. The expansion turbine 200 is fed with a slip stream taken from the second air stream at a region intermediate the stages 112 and 114 of the main heat exchanger 106. The air leaves the expansion turbine 200 at a temperature and pressure approximately the same as those occurring at the bottom region of the higher pressure rectification column 120. The expanded air is introduced into the higher pressure rectification column 120 through an inlet 202 at approximately the same level as that of the inlet 118.

The air separation process illustrated in FIG. 4 of the accompanying drawings is particularly useful when the lower pressure rectification column 128 is operated at elevated pressure, ie at a pressure at its top of greater than 2 bar. In a typical example of the operation of the plant shown in FIG. 4, the lower pressure rectification column 128 may be operated at a pressure at its top of about 3 bar, the intermediate rectification column 136 at a pressure at its top of about 7 bar, and the higher pressure rectification column 120 at a pressure at its top of about 10 bar. The mixing column 186 may be operated at a pressure of about 30 bar. The turbine 200 may have an inlet pressure of about 30 bar. The turbine 200 may have an outlet pressure of about 10 bar. Withdrawal of an oxygen stream from the lower pressure rectification column 128 in liquid state and operation of the lower pressure rectification column 128 are both factors which tend to depress the recovery (ie yield) of oxygen from the feed air by effectively depriving the lower pressure rectification column 128 of liquid nitrogen reflux. The operation of the intermediate rectification column 136 and the mixing column 186 ameliorates this tendency to the extent that greater than 99% recovery of an oxygen product containing about 95% by volume of oxygen can be achieved. In such an example the liquid oxygen stream withdrawn from the bottom of the lower pressure rectification column 128 typically contains about 98% by volume of oxygen. The recovery is much higher than that achievable in an equivalent lower pressure rectification column 128 if the intermediate column 136 is omitted.

The method according to the invention is further illustrated by the following example in Tables 1 and 2 of the operation of the plant shown in FIG. 4, which example is based on a computer simulation. For the sake of simplification, it is assumed that none of the columns or heat exchangers (except the lower pressure rectification column 128) causes a pressure drop.

TABLE 1

Results of Computer Simulator

| STREAM | STATE* (MOLE %) | TEMPERATURE/ K. | PRESSURE/ BAR | FLOW RATE $Sm^3\ hr^{-1}$ | COMPOSITION MOLE FRACTION $O_2$ | $N_2$ | Ar |
|---|---|---|---|---|---|---|---|
| A | V | 288.0 | 10.3 | 60770 | 0.21 | 0.78 | 0.01 |
| B | V | 108.6 | 10.3 | 60770 | 0.21 | 0.78 | 0.01 |
| C | L | 108.8 | 10.3 | 77157 | 0.38 | 0.61 | 0.01 |
| D | L | 107.3 | 10.3 | 77157 | 0.28 | 0.61 | 0.01 |
| E | L | 104.2 | 7.0 | 42600 | 0.48 | 0.51 | 0.01 |
| F | L-89% V-11% | 94.0 | 3.2 | 42600 | 0.48 | 0.51 | 0.01 |
| G | L-55% V-95% | 97.1 | 3.2 | 26896 | 0.48 | 0.51 | 0.01 |
| H | L | 98.6 | 7.0 | 12400 | 0.01 | 0.99 | — |
| I | L | 90.0 | 10.3 | 30751 | 0.01 | 0.99 | — |
| J | V | 88.0 | 3.0 | 78259 | — | 0.99 | — |
| K | V | 285.5 | 3.0 | 78259 | — | 0.99 | 0.01 |
| L | L | 102.7 | 3.2 | 29649 | 0.98 | — | 0.02 |
| M | L | 104.1 | 30.0 | 29649 | 0.98 | — | 0.02 |
| N | L | 141.4 | 30.0 | 29649 | 0.98 | — | 0.02 |
| O | V | 141.2 | 30.0 | 21741 | 0.95 | 0.02 | 0.03 |
| P | V | 285.5 | 30.0 | 21741 | 0.95 | 0.02 | 0.03 |
| Q | V | 146.7 | 30.0 | 34229 | 0.21 | 0.78 | 0.01 |
| R | V | 127.8 | 30.0 | 34229 | 0.21 | 0.78 | 0.01 |
| S | L | 129.4 | 30.0 | 42138 | 0.36 | 0.63 | 0.01 |
| T | L | 121.4 | 30.0 | 42138 | 0.36 | 0.63 | 0.01 |
| U | V | 150.0 | 30.0 | 5000 | 0.21 | 0.78 | 0.01 |
| V | V | 112.5 | 10.3 | 5000 | 0.21 | 0.78 | 0.01 |
| X | L | 104.3 | 10.3 | 2764 | 0.01 | 0.99 | — |

NOTES:
*V = 100% vapour
L = 100% liquid

TABLE 2

Explanation of Streams in Table 1

| STREAM | EXPLANATION |
|---|---|
| A | The first air stream at the warm end 108 of the main heat exchanger 106. |
| B | The first air stream at the inlet 118 to the higher pressure rectification column 120. |
| C | The oxygen-enriched liquid air stream at the outlet 130 of the higher pressure rectification column 120. |
| D | The sub-cooled oxygen-enriched liquid air stream at its outlet from the heat exchanger 132. |
| E | The oxygen-enriched air stream at the outlet 146 of the intermediate rectification column 136. |
| F | The oxygen-enriched air stream at its outlet from the second pressure reducing valve 148. |
| G | The oxygen-enriched air stream at the inlet 150 to the lower pressure rectification column 128. |
| H | The liquid nitrogen stream at the outlet 144 of the intermidiate rectification column 136. |
| I | The liquid nitrogen stream intermediate the heat exchanger 162 and the pressure reducing valve 164. |
| J | The product nitrogen stream at the outlet 174 of the lower pressure rectification column 128. |
| K | The product nitrogen stream at the warm end 108 of the main heat exchanger 106. |
| L | The liquid oxygen stream at the outlet 176 of the lower pressure rectification column 128. |
| M | The liquid oxygen stream at the outlet of the |
| N | The liquid oxygen stream at the inlet 184 to the mixing |

TABLE 2-continued

Explanation of Streams in Table 1

| STREAM | EXPLANATION |
|---|---|
| | column 186. |
| O | The gaseous oxyen product stream at the outlet 190 of the mixing column 180. |
| P | The gaseous oxygen product at the warm end 108 of the main heat exchanger 106. |
| R | The second stream of air at the inlet 190 to the mixing column 186. |
| S | The oxygen-enriched liquid air stream at the outlet 194 of the mixing column 186. |
| T | The oxygen-enriched liquid air stream at its exit from the heat exchanger 180. |
| U | The first stream of air at the inlet to the turbine 200. |
| V | The slip stream of air at the inlet 202 to the higher pressure rectification column 120. |
| W | The liquid nitrogen stream at the outlet 158 of the higher pressure rectification column 120. |

I claim:

1. A method of separating a mixture, comprising nitrogen and oxygen, comprising the steps of:

a) introducing a stream of the mixture into a higher pressure rectification column and separating it into oxygen-enriched liquid and nitrogen vapour;

b) condensing at least part of nitrogen vapour and employing a first stream of the condensate as reflux in the higher pressure rectification column and a second stream of the condensate as reflux in a lower pressure rectification column;

c) introducing a stream of the oxygen-enriched liquid into an intermediate vessel below liquid-vapour mass exchange devices therein at a pressure intermediate the pressure at the top of the higher pressure rectification column and the pressure at the bottom of the lower pressure rectification column, and separating the oxygen-enriched liquid by rectification therein into an oxygen-depleted vapour and liquid further enriched in oxygen;

d) reboiling a part of the further enriched liquid and thereby forming more oxygen depleted vapour;

e) reducing the pressure of a stream of the further-enriched liquid and employing it to condense at least some of the oxygen-depleted vapour so as to form condensed vapour and an at least partially vaporised, further enriched liquid, and introducing at least part of the partially vaporised, further enriched liquid into the lower pressure rectification column; introducing at least part of the said condensed vapour of step (e) into the lower pressure rectification column, or taking at least part of the said condensed vapour as product, or both;

g) separating an oxygen product from fluid introduced into the lower pressure rectification column;

h) reboiling liquid oxygen separated in the lower pressure rectification column by heat exchange with the condensing nitrogen vapour of step (b); and i) withdrawing a gaseous nitrogen product from the higher pressure rectification column.

2. A method of separating a mixture, comprising nitrogen and oxygen, comprising the steps of:

a) introducing a stream of the mixture into a higher pressure rectification column and separating it into oxygen-enriched liquid and nitrogen vapour;

b) condensing at least part of nitrogen vapour and employing a first stream of the condensate as reflux in the higher pressure rectification column and a second stream of the condensate as reflux in a lower pressure rectification column;

c) introducing a stream of the oxygen-enriched liquid into an intermediate vessel below liquid-vapour mass exchange devices therein at a pressure intermediate the pressure at the top of the higher pressure rectification column and the pressure at the bottom of the lower pressure rectification column, and separating the oxygen-enriched liquid by rectification therein into an oxygen-depleted vapour and liquid further enriched in oxygen;

d) rebelling a part of the further-enriched liquid and thereby forming more oxygen depleted vapour;

e) condensing at least part of the oxygen-depleted vapour by indirect heat exchange with liquid from an intermediate mass exchange level of the lower pressure rectification column, and introducing at least some of the further-enriched liquid into the lower pressure rectification column;

f) introducing at least part of the said condensed vapour of step (e) into the lower pressure rectification column, or taking at least part of the said condensed vapour as product, or both;

g) separating an oxygen product from fluid introduced into the lower pressure rectification column;

h) withdrawing a gaseous nitrogen product from the higher pressure rectification column; and i) reboiling liquid oxygen separated in the lower pressure rectification column by heat exchange with the condensing nitrogen vapour of step (b);

wherein no liquid nitrogen reflux for the higher and lower pressure rectification columns is formed by indirectly heat exchanging liquid from an intermediate mass exchange region of the lower pressure rectification column with nitrogen vapour from the higher pressure rectification column.

3. The method as claimed in claim 1, in which in step (c) nitrogen is produced as the oxygen-depleted vapour.

4. The method as claimed in claim 3, in which a part of the said condensed oxygen-depleted vapour is taken as liquid product.

5. The method as claimed in claim 3, in which some of the condensed oxygen-depleted vapour is returned to the intermediate vessel as reflux.

6. The method as claimed in claim 1, in which at least part of the said condensed oxygen-depleted vapour is introduced into the lower pressure rectification column.

7. A method of separating a mixture, comprising nitrogen and oxygen, comprising the steps of:

a) introducing a stream of the mixture into a higher pressure rectification column and separating it into oxygen-enriched liquid and nitrogen vapour;

b) condensing at least part of nitrogen vapour and employing a first stream of the condensate as reflux in the higher pressure rectification column and a second stream of the condensate as reflux in a lower pressure rectification column;

c) passing a stream of the oxygen-enriched liquid through a pressure-reducing valve to form a further mixture comprising liquid further enriched in oxygen and vapour depleted of oxygen and introducing the further mixture into an intermediate vessel at a pressure intermediate the pressure at the top of the higher pressure rectification column and the pressure at the bottom of the lower pressure rectification column so as to separate therein the vapour phase from the liquid phase;

d) reboiling a part of the further enriched liquid and thereby forming more oxygen depleted vapour;

e) reducing the pressure of a stream of the further-enriched liquid and employing it to condense at least some of the oxygen-depleted vapour so as to form condensed vapour and an at least partially vaporised, further enriched liquid, and introducing at least part of the partially vaporised, further enriched liquid into the lower pressure rectification column; introducing at least part of the said condensed vapour of step (e) into the lower pressure rectification column, or taking at least part of the said condensed vapour as product, or both;

g) separating an oxygen product from fluid introduced into the lower pressure rectification column;

h) reboiling liquid oxygen separated in the lower pressure rectification column by heat exchange with the condensing nitrogen vapour of step (b); and i) withdrawing a gaseous nitrogen product from the higher pressure column.

8. A method of separating a mixture, comprising nitrogen and oxygen, comprising the steps of:

a) introducing a stream of the mixture into a higher pressure rectification column and separating it into oxygen-enriched liquid and nitrogen vapour;

b) condensing at least part of nitrogen vapour and employing a first stream of the condensate as reflux in the higher pressure rectification column and a second stream of the condensate as reflux in a lower pressure rectification column;

c) passing a stream of the oxygen-enriched liquid through a pressure-reducing valve to form a further mixture comprising liquid further enriched in oxygen and vapour depleted of oxygen and introducing the further mixture into an intermediate vessel at a pressure intermediate the pressure at the top of the higher pressure rectification column and the pressure at the bottom of the lower pressure rectification column so as to separate therein the vapour phase from the liquid phase;

d) reboiling a part of the further-enriched liquid and thereby forming more oxygen depleted vapour;

e) condensing at least part of the oxygen-depleted vapour by indirect heat exchange with liquid from an intermediate mass exchange level of the lower pressure rectification column, and introducing at least some of the further-enriched liquid into the lower pressure rectification column;

f) introducing at least part of the said condensed vapour of step (e) into the lower pressure rectification column, or taking at least part of the said condensed vapour as product, or both;

g) separating an oxygen product from fluid introduced into the lower pressure rectification column; and h) withdrawing a gaseous nitrogen product from the higher pressure column; and i) reboiling liquid oxygen separated in the lower pressure rectification column by heat exchange with the condensing nitrogen vapour of step (b);

wherein no liquid nitrogen reflux for the higher and lower pressure rectification columns is formed by indirectly heat exchanging liquid from an intermediate mass exchange region of the lower pressure rectification column with nitrogen vapour from the higher pressure rectification column.

9. The method as claimed in claim 7 or claim 8, in which the lower pressure rectification column is operated at a pressure at its top in the range 3.5 to 6.5 bar.

10. The method as claimed in claim 7 or claim 8, in which the further enriched liquid is reboiled by indirectly heat exchanging it with a stream of nitrogen vapour withdrawn from the higher pressure rectification column, the stream of nitrogen vapour thereby thereby being at least partially condensed.

11. The method as claimed in claim 7 or claim 8, further including withdrawing the oxygen product in liquid state from the lower pressure rectification column; pressurising the oxygen product; creating a descending flow of the pressurised liquid oxygen through a liquid-vapour contact column of the mixing kind; intimately contacting the descending liquid oxygen with an ascending flow of pressurised vaporous air, and thereby forming pressurised gaseous oxygen product and a pressurising oxygen-enriched liquid air stream.

12. The method as claimed in claim 11, wherein the pressurised oxygen-enriched liquid air stream is introduced into the intermediate vessel or the higher pressure rectification column.

13. The method as claimed in claim 7 or claim 8, in which the mixture comprising nitrogen and oxygen is formed by separating water vapour and carbon dioxide from a stream of compressed air, and cooling the resultant purified air stream to a cryogenic temperature suitable for its separation by rectification.

* * * * *